United States Patent [19]

Kinsman et al.

[11] Patent Number: 4,574,053

[45] Date of Patent: Mar. 4, 1986

[54] SOAP/SYNDET BARS FILLED WITH FATTY ACID COATED REACTIVE FILLER

[75] Inventors: Donald V. Kinsman, Fort Thomas; Clement H. Luken, Jr., Highland Heights, both of Ky.

[73] Assignee: National Distillers and Chemical Corporation, New York, N.Y.

[21] Appl. No.: 656,805

[22] Filed: Oct. 1, 1984

[51] Int. Cl.[4] ..... C11D 17/00

[52] U.S. Cl. ..... 252/134; 252/129; 252/131; 252/174; 252/DIG. 16

[58] Field of Search ..... 252/133, 129, 131, 134, 252/174, DIG. 16

[56] References Cited

FOREIGN PATENT DOCUMENTS 0148788 10/1952 Australia .

*Primary Examiner*—Paul Lieberman
*Assistant Examiner*—John F. McNally
*Attorney, Agent, or Firm*—Kenneth D. Tremain; Gerald A. Baracka

[57] ABSTRACT

Soap, combo or syndet bars are filled with particulate inorganic filler materials wherein the particles of the filler are coated with fatty acid which has reacted chemically with the filler.

23 Claims, No Drawings

SOAP/SYNDET BARS FILLED WITH FATTY ACID COATED REACTIVE FILLER

FIELD OF THE INVENTION

This invention relates to bars formed from soap, or synthetic detergent (syndet) or from combinations of soap and synthetic detergent, which are filled with particulate inorganic filler material wherein the particles of filler material are coated with fatty acid that is reacted chemically with the filler.

DESCRIPTION OF THE PRIOR ART

Various fillers or filler type materials have been used for various purposes in syndet bars (Manufacture and Properties of Synthetic Toilet Soaps; by Martin Hollstein and Luis Spitz; in JAOCS, Vol. 59, No. 10, October 1982, pages 442–443, and in Soap/Cosmetics/-Chemical Specialties, January 1983, page 30); and in soap bars, (American Soap Makers Guide by I. V. Stanley Stanislaus P. B. Meerbott, 1928, pages 371–374 and 435–438).

Coarse sized and rough surfaced fillers such as pumice or sand have also been added to soap or syndet bars for the purposes of supplying an abrasive agent to the resulting product. The resulting grittiness of such products is a desired and tolerable attribute of such bars. Very fine particle sized materials such as $TiO_2$ have also been added to soap or syndet at relatively low levels of about 1 to 2 weight % for pigmenting purposes.

Great Britain Patent Applications 2,083,490 and 2,083,491 disclose the use of bentonite and/or kaolin in syndet bars to improve the hardness of the bars.

$Al_2O_3$ coated $TiO_2$ has been proposed as a filler, in combination with 1-hydroxy-ethane-1, 1-diphosphonic acid, for soap requiring improved storability (C.A. 92: 200144m, T. Matsukura et al.).

Great Britain Patent Application 2,004,564 discloses the use of free $C_1$ to $C_8$ dicarboxylic acids to improve the lather and rate of wear, or mushing, of soap bars.

Colloidal silica, added to soap bars via a special process, has also been proposed as a filler for soap (Soap/-Cosmetics/Chemical Specialties, June 1976, page 42 et seq; and October 1978, pages 32–33) that was to be devoid of coconut oil.

These references, however, do not address the problem of using relatively large amounts of particulate inorganic filler materials in soap or syndet bars for the purposes of extending the soap or syndet stock without causing the user thereof to experience any significant amount of grittiness and without causing any deterioration in the desirable qualities of such bar products.

THE OBJECTS OF THE PRESENT INVENTION

An object of the present invention is to facilitate the use of filler materials in soap and syndet bars without contributing any significant grittiness properties to the bars.

Another object of the present invention is to facilitate the use of filler materials in soap and syndet bars without detracting from the desired properties of such products, while realizing attendant cost savings.

Another object of the present invention is to provide for the ability to process soap or syndet bars containing significant levels of normally abrasive fillers in equipment such as mills and plodders without damaging such equipment.

Another object of the present invention is to provide a means for imparting, to the user of the filled bars of the present invention, the perception of increased richness/creaminess using a lower effective level of fatty acid, as a coating on filler materials, than would otherwise be required to improve the richness/creaminess of soap and syndet bar products using only fatty acid, unsupported on a filler, as a superfatting agent.

SUMMARY OF THE INVENTION

It has now been found that soap or syndet bars can be prepared with significant levels of particulate inorganic filler material therein, without detracting from the desired qualities of such products and without causing the user thereof to experience any significant feeling of grittiness while using such products, if the particulate filler is coated with fatty acid that is chemically bound to the filler particles.

DESCRIPTION OF THE INVENTION SOAP AND SYNDET BARS

The soap bars that are the subject of this invention can have wide variations in composition depending on how they are prepared, as well as on the selection of additives, and amounts thereof, that may be used in such soap bars to achieve certain desirable attributes. Aside from the use of the fillers required by the present invention, the soap bar compositions are thus of the types well known to those in the art.

The soap bars of the present invention will contain about 65 to about 90% by weight of soap. The plodded soap bars of the present invention will have a moisture content, depending on the amount of other additives therein, of about 5 to 18%, and more typically, of about 8 to 12%. Although special drying processes may be used to provide framed soap bars having moisture levels of less than 10%, the framed soap bars typically have higher moisture levels of up to about 30% or more, but most typically the moisture is in the range of about 15 to 20%.

The soap employed in the soap bars is preferably the sodium salt of a soap base fatty acid. Other salts may also be used, such as potassium and alkanolamines. The fatty acid used as the soap base may be any of those employed in the manufacture of soap including those contained in coconut oil, palm oil, palm kernel oil, beef tallow, mutton tallow, olive oil, lard, babassu oil, peanut oil, corn oil, sesame oil, ucuhuba fat, Chinese vegetable tallow, whale oil, menhaden oil, grease, castor oil and soybean oil, as well as fatty acids derived from synthetic sources and mixtures of two or more of such fatty acid materials.

The soap base may also be produced from fats and oils.

The most important fatty acids to be used in the process of making the soap are the following saturated acids: caprylic acid, capric acid, margaric acid, lauric acid, myristic acid, palmitic acid and stearic acid, and the following unsaturated acids: oleic acid, linoleic acid, myristoleic acid, palmitoleleic acid, and linolenic acid.

The most important fatty acid based compositions that may be used as the soap base in the soap bars of the present invention are stearic acid, coco fatty acids and tallow fatty acids, as well as mixtures of these fatty acids. The more common of these mixtures of these acids are those containing tallow:coco fatty acid ratios of 80:20, 85:15, 70:30 and 50:50, with the tallow:coco fatty acid ratios of 80:20 and 85:15 being the most common.

The soap bars of the present invention may also contain about 3 to 15%, and more preferably about 4 to 6%, glycerine. Superfatting agents may also be used in the soap bars of the present invention. These superfatting agents would include unneutralized fatty acids, fats and oils and mineral oils. The fatty acids are the more preferred of such agents. The superfatting agents are preferably used in amounts of about 3 to 6%, but amounts of up to about 10 to 15% may also be used. The fatty acid materials used to coat the fillers of the present invention can also provide "superfatting effects" at effective fatty acid coating levels of about $\leqq 0.3\%$, based on the total weight of the soap composition in which the coated filler is used.

Other additives commonly employed in the soap bar making arts may also be used in the soap bars of the present invention such as colorants, such as $TiO_2$, perfumes, stabilizers, bacteriostats (as deodorants), and processing aids such as common salt. All of these other additive materials are used at maximum levels of about 1%, except for perfumes which may be used at levels of up to about 2 to 3%.

The syndet bars that are the subject of the present invention will have a wide variation in composition depending on the selection of the materials to be used therein. In addition to the filler materials of the present invention, the syndet bars will contain materials that are commonly used by those in the arts in making such syndet bars, such as surfactants, plasticizers/binders and other additives.

Examples of the surfactants, plasticizers/binders and additives, other than fillers, that may be used in the syndet bars of the present invention are disclosed in the Article by M. Hollstein and L. Spitz which is noted above, and the full disclosure of which is incorporated herein by reference.

The preferred surfactants to be used in the syndet bars of the present invention are alkali metal salts of acyl isethionates, fatty alcohol sulfates and alkane sulfonates, alone, or in the various admixtures thereof which are noted in the M. Hollstein and L. Spitz article, supra. Other surfactants that may be used would include sodium lauryl sulfoacetate, fatty acid sarcosinates, sodium lauryl glyceryl sulfonate and sodium dodecyl benzene sulfonate. The surfactants are used in the syndet bars of the present invention at a level of about 15 to 70, and preferably of about 15 to 20, weight percent, based on a solids content basis.

Superfatting agents, of the types used in the soap bars, as described above, may also be used in the syndet bars of the present invention. The fatty acids, particularly stearic acid and coco fatty acid are the preferred superfatting agents for this purpose. In addition to providing superfatting effects in the syndet bars, these superfatting agents also serve as processing acids. The superfatting agents are used in the syndet bars at levels of about 5 to 35% and preferably of about 15 to 25 weight percent.

Other additives that may be used in the syndet bars of the present invention would include perfumes, colorants, processing acids such as sodium chloride, bacteriostats and preservatives or stabilizers, which are all well known in the art. These other additives are each used at levels of about 1 weight percent or less, except for the perfumes which may be used at levels of up to about 2 to 3 weight percent.

The basic concept of the present invention, of using fillers coated with fatty acids, is useful not only with bar products made only of soap, or only of synthetic detergent, but may also be used with so-called combo (combination) bars which contain both soap and synthetic detergent. Such combo bars may contain about 5 to 70%, and preferably about 10 to 35%, soap and about 10 to 80% and preferably about 10 to 35% synthetic detergent. In such combo bars, the soap aids in the processing of the product by imparting the plasticity and binding needed for plodding. The soap also imparts a soap-like feel during the usage of the combo bar. The soap is thus the preferred plasticizer for the combo bars.

Additives of the types disclosed above for use in the soap and syndet bars may also be used, and in amounts commonly used in the art for such purposes, in the combo bars of the present invention.

The fillers that are to be used in the soap, syndet or combo bars of the present invention are water insoluble inorganic materials having an average particle size of about 0.05 to 20 microns, and preferably of about 0.5 to 5.0 microns.

The fillers that are to be used in the present invention are preferably pretreated by being ground to achieve the desired particle size, if necessary, and/or they may be chemically precipitated to provide a desired particle size.

The fillers that may be used in the syndet, combo or soap based compositions are those that will chemically react with the fatty acid used to coat such fillers. Such reactive fillers are preferably those that form salts with fatty acids. These salt forming reactive fillers will be, preferably, those having cations formed from metals such as Ca, Mg, Al and Zn, and preferably those wherein the cation is $Ca^{++}$, $Mg^{++}$, $Al^{+++}$, and $Zn^{++}$.

These salt forming reactive fillers would include $CaCO_3$, $[CaMg(CO_3)_2]$, $Ca(BO_2)_2$, $Ca(OH)_2$, $MgCO_3$, CaO, MgO, $Al(OH)_3$, ZnO and $ZnCO_3$.

The reactive fillers used in the soap, syndet and combo bar products of the present invention, having reacted with the fatty acid coating during the coating process of the present invention, as described below, tend to retain the full thickness of the attached reacted salt placed thereon during any subsequent processing steps. Further, the reacted fatty acid moiety thereon is less prone to any reactions that might otherwise arise therewith during the shelflife or use of the product that might lead to discoloration or rancidity of the bar product.

The color of the filler should be compatible with the color of the bar product in which the filler is to be used.

About 1 to 25, and preferably about 3 to 12, weight percent of the coated filler is used in the bar products of the present invention, based on the total solids in the soap, combo or syndet bar formulation. About 0.5 to 10 and more preferably about 3 to 6 weight percent fatty acid, based on the total weight of the coated filler, is reacted with the filler.

The individual fatty acid which is to be used to coat the filler materials in the bar products of the present invention may be saturated or unsaturated $C_4$ to $C_{26}$, and preferably $C_8$ to $C_{18}$, monocarboxylic acids. The preferred of such acids are the saturated acids, and particularly stearic acid, coconut acid, plamitic acid, myristic acid and lauric acid. The unsaturated acids that may be used include, but are not limited to, those containing only one unsaturated double bond, such as oleic acid, palmitoleic acid and myristoleic acid. The use of the unsaturated acids is not desired where there is an enhanced likelihood of oxidation of such fatty acids which would lead to undesired color formations and/or rancidity in the bar products.

The fatty acids may be used, for filler coating purposes, individually or in various combinations thereof. These are most preferably used in such combinations thereof as are commonly found in the natural fats and oils which are commonly employed in the soap making industry, i.e., tallow, coconut oil, palm oil and palm kernel oil.

In preparing the filled bar products of the present invention, the following procedure is followed.

The particulate filler is first treated to remove chemically uncombined water therefrom. This is usually done by heating.

The dried particulate filler is then precoated with the fatty acid. This is usually done at a temperature of about 95°±5° C., or about 40° to 70° C. above the melting point of the fatty acid being used. This takes about 0.5 to 2.0 hours with the reactive fillers of the present invention. The heating of the fatty acid and reactive filler is conducted for a period of time sufficient to cause a chemical reaction to occur between the cations of the filler and the carboxyl groups of the fatty acid, so that substantially all of the exposed cation reactive sites of the filler, i.e., on the surface thereof and/or in any exposed pores therein, are reacted with such carboxyl groups, subject, of course, to limitations that might be imposed due to steric hinderance, the physical shape of the particle and any subsequent stress placed on the bonded particles. The adequacy of the reaction time needed in this regard can be independently arrived at by testing the coated filler to see whether or not it has any exposed unreacted cation sites. This can be done, for example, by a hydrophobicity test.

Adequately coated and bonded fillers are those in which at least 75%, and preferably at least 90%, of the carboxylic acid functional groups have reacted with the available filler cation sites.

The coating step is conducted with sufficient stirring of the heated filler/fatty acid admixture as to insure that at least substantially all of the individual filler particles are separately coated, and are not allowed to agglomerate.

The coated filler materials are then recovered and allowed to cool to a temperature of 30°±10° C. Where the coated filler is being used in a soap bar the coated filler particles are preferably added to the fatty acid that is to be saponified for the purposes of forming the soap base for such bar product (the soap forming fatty acid) while such soap forming fatty acid is heated at a temperature of about 65°±5° C., or at a temperature which is about 20° to 30° C. above the melting temperature of the soap forming fatty acid. A slurry of the coated filler particles in the soap forming fatty acid is thus formed. The caustic saponifying agent, usually a 30 to 35 weight percent aqueous solution of NaOH, is preheated to 55°±5° C. and then added, with agitation to the slurry of coated filler and soap forming fatty acid. The saponification reaction is exothermic and produces water. The excess heat and water are removed by vaporation. The temperature of the saponification mixture is maintained at about 100°±5° C. for about 2 to 5 minutes to assure the desired amount of saponification to occur between the added caustic and the soap forming fatty acid. Under these conditions the coating on the fillers is substantially unaffected by the elevated temperature/agitation conditions encountered during the saponification process.

Although the filler materials are preferably added, during the manufacture of a filled soap bar, to the fatty acid which is to be saponified prior to saponification, the filler can also be added to the soap, after saponification, in the crutcher, plodder, refiner, etc. which are commonly used in the soap making art. Except for the use of the filler of the present invention, the soap making process involved in making the soap bar products of the present invention is as it is commonly employed in the soap bar making art. The coated filler/saponification mixture is agitated to assure uniform saponification and a uniform dispersion of the filler in the saponified composition.

Where the coated filler is to be used in a syndet or combo bar the coated filler materials is first prepared as disclosed above and is then added to the other components of the syndet bar formulation heated at 40°±10° C. and the composition is agitated for a period of time sufficient to allow the filler to be uniformly dispersed throughout it.

After the thus filled soap, combo or syndet formulations have been prepared, bar products can be made therefrom by conventional bar making procedures. The bars may be plodded, and optionally milled, or framed/cast.

The following examples are merely illustrative of the present invention and are not intended as a limitation on the scope thereof.

EXAMPLES

I. Preparation of Coated Fillers

I.1 $CaCO_3$ Coated with 3% Coconut Fatty Acid $CaCO_3$ (291 grams) was placed in a crimped 2000 ml three necked round bottom flask equipped with a mechanical stirrer. The $CaCO_3$ was in particle form having an averge particle size of about 1.0 micron. The $CaCO_3$ was first heated up to 100° C. in the flask over a period of 20 minutes with mechanical stirring and then heated at 100° C. with mechanical stirring for 15 minutes to thoroughly dry the $CaCO_3$. Any water present was exhausted through a line. Nine grams coconut fatty acid (titer 23.2° C., 1.0 maximum iodine value, acid value 270–276, saponification value 270–276 and comprised of approximately 1 wt.% oleic acid, 7 wt.% stearic acid, 10 wt.% palmitic acid, 18 wt.% myristic acid, 51 wt.% lauric acid, 6 wt.% capric acid and 7 wt.% caprylic acid) was then added to the $CaCO_3$ and the temperature (about 100° C.) and agitation were maintained for two hours. The resulting $CaCO_3$ was cooled and was in the form of particles coated and reacted with a film of fatty acid. The fatty acid represented 3% of the combined weight of the filler and the coating.

I.2 $CaCO_3$ Coated with 3% Mineral Oil

Particulate $CaCO_3$ (194 grams) was placed in a 1000 ml three necked round bottom flask equipped with a mechanical stirrer and a line. The $CaCO_3$ was first heated up to 100° C. over a period of 9 minutes with mechanical stirring and then heated at 100° C. under 70 mm Hg for 15 minutes with mechanical stirring to thoroughly dry the $CaCO_3$. Any water present was exhausted through the line. Mineral oil (6.0 grams Arcoprime NF 70) was then added to the $CaCO_3$ and the temperature (about 100° C.) and agitation were continued for two hours. The resulting $CaCO_3$ was cooled and was in the form of individual particles coated with the mineral oil. The mineral oil did not react with the $CaCO_3$. The coated $CaCO_3$ was stored in an air tight bottle. The weight of the mineral oil coating represented 3% of the combined weight of the $CaCO_3$ and the coating.

This mineral oil coated $CaCO_3$ is not a coated filler within the context of the present invention but is to be used for comparison purposes, as disclosed below.

I.3 $Al(OH)_3$ Coated With 3% Oleic Acid $Al(OH)_3$ (194 grams) was placed in a 1000 ml three necked round bottom flask equipped with a mechanical stirrer and an exhaust line. The $Al(OH)_3$ was in particle form having an average particle size of about 1 to 2 microns. The $Al(OH)_3$ was first heated up to 100° C. over a period of 23 minutes with mechanical stirring and then heated at 100° C. for 14 minutes with mechanical stirring to thoroughly dry the $Al(OH)_3$. Any water present was exhausted through the exhaust line. Six grams of a commercial oleic acid product (titer 2°-6° C., iodine value 86-90, acid value 200-204, saponification value 202-206 and containing approximately 74 wt.% oleic acid) was then added to the $Al(OH)_3$ and the temperature (about 100° C.) and agitation were continued for one hour and 33 minutes. The resulting $Al(OH)_3$ was cooled and it was in the form of particles coated with a film of the oleic acid.

The 6.0 grams of oleic acid coating that was employed represented 3% of th combined weight of the coating and the $Al(OH)_3$.

I.4 [$CaMg(CO_3)_2$] Coated With 3% Coconut Fatty Acid

Particulate $CaMg(CO_3)_2$ or dolomite (194 grams) was charged into a 1000 ml three necked round bottom flask equipped with a mechanical stirrer and an exhaust line. The material was slightly gritty to the touch. The dolomite was first heated up to 100° C. over a period of 20 minutes with mechanical stirring and then heated at 100° C. for 15 minutes with mechanical stirring to dry the dolomite. Any water present was exhausted through the exhaust line. Coconut fatty acid (6.0 grams) was then added to the dolomite and the temperature (100° C.) and agitation were continued for 1 hour. The coconut fatty acid was the same as that used in Example I.1 above. The heat was turned off and the system was cooled with continued agitation. The resulting dolomite product was in the form of particles coated and reacted with a film of the coconut fatty acid. The coated dolomite was gritty to the touch. The weight (6 grams) of the fatty acid coating that was applied to the dolomite represented 3% of the combined weight of the coating and the dolomite.

I.5 Pumice Coated With 6% Stearic Acid

Particulate pumic (188 grams) was added to a 1000 ml three necked round bottom flask equipped with a mechanical stirrer and an exhaust line. It was very gritty to the touch. The pumice was first heated up to 100° C. over a period of 10 minutes with mechanical stirring and then heated at 100° C. for 15 minutes with mechanical stirring to thoroughly dry the pumice. Any water present was exhausted through the exhaust line. The stearic acid (12 grams) was then added to the pumice and the temperature (100° C.) and agitation were continued for 2 hours. The product was then cooled and it was in the form of particles coated with a film of the stearic acid. The thus coated pumice was not as gritty to the touch as was the uncoated pumice.

The stearic acid employed was a commercial product containing approximately 65 wt.% saturated $C_{18}$ monocarboxylic acid, 29 wt.% $C_{16}$ saturated monocarboxylic acid and 14 wt.% $C_{14}$ saturated monocarboxylic acid and having a titer of 57°-63° C., maximum iodine value of 2, acid value of 200-209 and saponification value of 201-208.

The weight of the stearic acid coating that was applied to the pumice represented 6% of the combined weight of the coating and the pumice.

I.6 Pumice Coated With 10% Stearic Acid

Pumice coated as in Example I.5 above (196.7 grams) was charged to a 1000 ml three necked round bottom flask equipped with a mechanical stirrer and a vacuum line. The (6% coated) pumice was first heated up to 100° C. over a period of 15 minutes with mechanical stirring. Due to the tendency of the stirred coated pumice to adhere to the inside walls of the flask, it was necessary to continue the heating for about an additional hour while freeing the pumice from the walls. Then an additional 8.74 grams of stearic acid, in the form of flakes, was added and the temperature (100° C.) and agitation were continued for 30 minutes. The heat and agitation were turned off and the system was cooled to room temperature. The resulting product was in the form of particles of pumice coated with a film of stearic acid. It was much less gritty than the 6% coated material of Example I.5.

The stearic acid used in this Example was the same as that used in Example I.5 above. The total weight (12.0 and 8.74 grams) of the stearic acid coating that was applied, stepwise, to the pumice in Examples I.5 and I.6 represented 10% of the combined weight of the coating and the pumice, as produced in this Example I.6.

Additional coated filler materials that were employed in the examples disclosed below are as follows:

I.7 A particulate $CaCO_3$ coated with about 1.2 weight percent of stearic acid and purchased commercially. The coated particles have an average particle size of about 1.0 micron.

I.8 A coated particulate $CaCO_3$ made as in Example I.1 with a coating of 2 weight percent of coconut fatty acid.

I.9 A coated particulate $CaCO_3$ made as in I.1 with a coating of 3 weight percent of coconut fatty acid. The $CaCO_3$ was precipitated.

I.10 Particulate pumice was coated with 3 weight percent coconut fatty acid using a procedure as in Example I.5.

I.11 A coated particulate $CaCO_3$ was made as in I.1 with a coating of 3% stearic acid using the stearic acid of Example I.5.

II. Preparation Of Filled Soap Bars

A number of filled soap bars were prepared using various coated fillers, as prepared above. For comparison purposes some unfilled soap bars and some soap bars filled with uncoated fillers were also prepared. The fatty acid base used for the soap component of the bars was either one or the other of two tallow/coco fatty acid blends (E-515 and E-516), or it was an admixture of a tallow fatty acid (E-531) and coconut fatty acid (E-626). The fatty acids had the following specifications and compositions:

TABLE 1

| | SPECIFICATIONS | | | | |
|---|---|---|---|---|---|
| | Titer °C. | Iodine Value | Acid Value | Saponification Value | Unsaps %, Max |
| E-515 | 35–40 | 44–54 | 212–218 | 214–220 | 0.5 |
| E-516 | 39–45 | 35–42 | 214–218 | — | 0.5 |
| E-531 | 40.5–43.0 | 45–56 | 203–208 | 203–209 | 1.5 |
| E-626 | 23–26 | 1.0 Max | 270–276 | 270–276 | — |

TABLE 2

| | TYPICAL COMPOSITION IN WEIGHT PERCENT OF COMPONENT ACIDS | | | | | | | |
|---|---|---|---|---|---|---|---|---|
| | SATURATED ACIDS | | | | UNSATURATED ACIDS | | | |
| | $C_{12}$ | $C_{14}$ | $C_{16}$ | $C_{18}$ | $C_{16}$ | $C_{18}$ (Mono) | $C_{18}$ (Di) | Other |
| E-515 | 11.4 | 6.3 | 22.5 | 16.5 | 3.0 | 34.2 | 2.5 | 3.6* |
| E-516 | 9.5 | 7.0 | 23.5 | 20.5 | 1.8 | 33.5 | 1.5 | 2.5* |
| E-531 | 0 | 3 | 26.5 | 17 | 5 | 42 | 3 | 3.5* |
| E-626 | 51 | 18 | 10 | 7 | 0 | 1 | 0 | 13** |

*About 0.5–1.5 wt. % each of linolenic, margaric and pentadecanoic acids.
**About 6–7 wt. % each capric and caprylic acids.

In preparing filled soap bars according to the present invention, the following formulations were employed.

TABLE 3

| Component | Grams Of Component In Soap Formulation | | | | |
|---|---|---|---|---|---|
| Fatty Acid | 1500 E-515 | 1500 E-516 | 750 E-516 | 750 E-531/ 750 E-626 | 105 E-531/ 450 E-626 |
| NaOH, 98.8% | 235 ± 3 | 235 ± 3 | 118 ± 2 | | |
| $H_2O$ Distilled | 600 ± 5 | 600 ± 5 | 300 ± 3 | | |
| Stabilizer: Ortho tolyl biguanide | 0.15 | 0.15 | 0.08 | 0.15 | 0.15 |
| Filler, Zero Loading | 0 | 0 | 0 | 0 | 0 |
| *Filler, 5% Loading | 75 | 75 | 37.5 | 75 | 75 |
| *Filler, 9.7% Loading | 145.5 | 145.5 | — | 145.5 | 145.5 |
| *Filler, 10% Loading | 150 | 150 | 75 | 150 | 150 |

*Percentage based upon weight of fatty acid to be saponified.

In making each soap bar composition, filled or unfilled, the fatty acid, stabilizer and coated filler, where used, were separately mixed together and heated to about 65° C.

The NaOH and $H_2O$ were combined separately, allowed to exotherm, and dissolve, with stirring, all the NaOH and was then cooled to about 55° C. The fatty acid mixture was agitated in a 4 quart Hobart mixer and the aqueous solution of NaOH was added slowly to the fatty acid admixture and stirred until it was homogeneous. The saponification reaction usually required about 3 to 5 minutes. The resulting product, while hot, (about 90° C.) was poured into a shallow glass pan and allowed to cool. Soap bars were then processed from the raw cool soap mixture.

The additional Examples provided below disclose more specifically the soap or syndet base and fillers used in the sample evaluated, for the purposes of demonstrating the teachings of the present invention.

III. Evaluations Of Soap And Syndet Samples

The various samples of filled and unfilled soap and syndet prepared as disclosed below were each evaluated by a panel of five panelists. Each sample was evaluated for its flash foam, lather volume and lather richness/creaminess characteristics by having each panelist use the test samples to wash his/her hands in tap water that was moderately hard, and as the panelist would otherwise normally use a soap/syndet/combo bar for this purpose.

Each panelist was then required to evaluate each of these characteristics for each sample and award a numerical ranking on a scale of 1 to 5 for each characteristic, with a ranking of 5 being the most favorable ranking, and the rankings of 4, 3, 2, and 1 being considered less favorable in that order of ranking. The compilation of the panelists rankings for each of the test characteristics for each product are provided below as simple arithmetical averages of each set of the five panelists rankings for each characteristic.

The standards to be used by the panelists in applying numerical rankings for each test characteristic were the following:

| | Ranking |
|---|---|
| Flash Foam Characteristic | |
| Very quickly | 5 |
| Quickly | 4 |
| About average | 3 |
| Slowly | 2 |
| Very slowly | 1 |
| Lather Volume | |
| Very large | 5 |
| Large | 4 |
| Average | 3 |
| Less than average | 2 |
| Very low | 1 |
| Richness/Creaminess | |
| Very thick/rich | 5 |
| Richer/thicker than average | 4 |
| Average | 3 |
| Thinner than average | 2 |
| Very thin | 1 |

The average of the test results found by the panelists for the tested bars were as disclosed in the following Examples:

EXAMPLES 1–5

Various soap bars were made from the E-516 fatty acid blend to demonstrate the advantages of using such soap bars filled with 5% $CaCO_3$, and wherein the $CaCO_3$, where used, was either uncoated, or was reacted and coated with stearic acid as disclosed in Examples I.7 and I.11 hereof, in accordance with the teachings of the present invention. These soap bar compositions were as follows:

TABLE 4

| Composition/ Example | Weight % Uncoated Filler | Weight % Coated Filler | Coating On $CaCO_3$ Fatty Acid | Coating On $CaCO_3$ Weight % |
|---|---|---|---|---|
| 1 | 0 | 0 | None | — |
| 2 | 5 | 0 | None | — |
| 3 | 5 | 0 | None | — |
| 4 | 0 | 5 | Stearic | 1.2 |
| 5 | 0 | 5 | Stearic | 3.0 |

The soap bars of Examples 1, 2 and 3 were control or comparison samples. The $CaCO_3$ used in all these examples was ground $CaCO_3$. The resulting bar products were then evaluated for flash foam, lather volume and richness/creaminess characteristics by a test panel. The following Table lists the results of such evaluations:

TABLE 5

| Product Of Example | Average Panel Ratings For: Flash Foam | Lather Volume | Richness/ Creaminess |
|---|---|---|---|
| 1 | 3.0 | 3.4 | 3.2 |
| 2 | 2.8 | 2.4 | 2.8 |
| 3 | 2.8 | 2.0 | 2.4 |
| 4 | 3.2 | 3.6 | 3.8 |
| 5 | 3.2 | 3.6 | 3.8 |

The bar of Example 2 exhibited some grittiness, while that of Example 3 was very gritty. The other bars exhibited no grittiness. The test results indicate that the filled soap bars of the present invention provide significant improvements in the evaluated properties as compared to the filled and unfilled control samples. It should be noted in this regard that these improvements in properties are obtained with coated fillers that contain very small amounts of added fatty acid (in the form of the coatings on the filler). The soap bar of Example 4 thus only required 0.06% of such fatty acid, and the soap bar of Example 5 only required 0.15% of such fatty acid.

EXAMPLES 6–12

Various soap bars were made from the E-515 fatty acid blend to demonstrate the advantages of using such soap bars filled with 10% $CaCO_3$, and wherein the $CaCO_3$ was reacted and coated with various fatty acids, as disclosed in Examples I.7, I.11, I.8, I.1 and I.9, respectively, in accordance with the teachings of the present invention. These soap bar compositions were as follows:

TABLE 6

| Composition/ Example | Weight % (Coated) $CaCO_3$ | Coating On $CaCO_3$ Fatty Acid | Weight % |
|---|---|---|---|
| 6 | 0 | None | |
| 7 | 0 | 3% Stearic Acid added as superfatting agent | |
| 8 | 10 | Stearic | 1.2 |
| 9 | 10 | Stearic | 3 |
| 10 | 10 | Coco | 2 |
| 11 | 10 | Coco | 3 |
| 12 | 10 | Coco | 3 |

The soap bars of Examples 6 and 7 were control samples. The $CaCO_3$ used in Example 12 was precipitated $CaCO_3$. In the other Examples 8 to 11, it was ground $CaCO_3$. The resulting bar products were then evaluated for flash foam, lather volume and richness/creaminess characteristics by a test panel. The following Table 7 lists the results of such evaluations:

TABLE 7

| Product Of Example | Average Panel Ratings For: Flash Foam | Lather Volume | Richness/ Creaminess |
|---|---|---|---|
| 6 | 3.0 | 2.4 | 2.4 |
| 7 | 2.4 | 3.4 | 3.8 |
| 8 | 2.0 | 2.2 | 2.8 |
| 9 | 3.4 | 2.8 | 4.0 |
| 10 | 3.4 | 3.4 | 3.4 |
| 11 | 3.8 | 3.6 | 3.8 |
| 12 | 3.4 | 3.2 | 3.6 |

The bar of Example 8 exhibited a slight grittiness. The test panel results indicate that the filled soap bars of the present invention generally provide significant improvements in the evaluated properties as compared to the unfilled control samples. It should be noted in this regard that these improvements in properties are obtained with coated filler that contain very small amounts of added fatty acid (in the form of the coatings on the filler) as compared to the amount of superfatting agent used in Example 7. Whereas the superfatting agent was used at a 3% weight level, the coatings were used at levels of only 0.12% (Example 8), 0.20% (Example 10) and 0.30% in the other examples (based on the total weight of the soap bars).

EXAMPLES 13 TO 16

Filled bars were prepared (reconstituted) from commercially available soap and syndet bars, i.e., Procter and Gambles "Zest" syndet bars and Lever Brother "Lux" soap bars. Bars of each of these materials were noodled, and to about 1800 grams of each of these noodled soaps there was added about 150 grams of coated $CaCO_3$ prepared as disclosed in Example I.1 above and about 150 grams of water. The water is used to facilitate the processing of the noodled soap or syndet composition through Mazzoni units. The resulting compositions were then stamped to reform bars therefrom. Lux soap is based on the use of about an 80/20 weight percent admixture of tallow/coco fatty acids. The Zest syndet is based on potassium lauryl sulfate surfactant.

The reformed, filled, Lux soap and Zest syndet bars were then evaluated for flash foam, lather volume and richness/creaminess characteristics by a test panel. The following Table 8 lists the results of such evaluations.

TABLE 8

| Product Of Example | Average Panel Ratings For: Flash Foam | Lather Volume | Richness/ Creaminess |
|---|---|---|---|
| 13 Unfilled Lux Soap[1] | 3.2 | 3.2 | 3.4 |
| 14 Filled Lux Soap[2] | 4.0 | 4.0 | 4.2 |
| 15 Unfilled Zest Syndet[1] | 3.2 | 3.2 | 3.6 |
| 16 Filled Zest Syndet[2] | 3.8 | 4.4 | 3.6 |

[1] Bars as purchased
[2] Bars as reformed according to present invention, as described above.

None of the products exhibited any grittiness. The tabulated panel results show that the filled products of the present invention of Examples 14 and 16, on average, provided significant improvements over the unfilled commercial products of Examples 13 and 15, respectively.

EXAMPLES 17 AND 18

A filled syndet bar was formed from a sodium isethionate based composition containing sodium cocoyl isethionate, stearic acid, water, hydrogenated tallow glyceride and hydrogenated tallow amide. A filled syndet bar, in accordance with the present invention, was prepared from 50 grams of the sodium isethionate composition, 4.49 grams of coated $CaCO_3$ prepared as disclosed in Example I.1 above, and 10 grams of water. A control bar was made without the filler. In each case, the sodium isethionate composition, water, and coated filler, where used, was agitated with heat until a homogenous blend was obtained. The resulting compositions were then poured into a mold, pressed, and allowed to cool. The bars were then evaluated for flash foam, lather volume and richness/creaminess characteristics by a test panel. The following Table 9 lists the results of such evaluations:

TABLE 9

| Product Of Example | Average Panel Ratings For: Flash Foam | Lather Volume | Richness/ Creaminess |
|---|---|---|---|
| 17 Unfilled Syndet Bar | 2.0 | 2.0 | 2.0 |
| 18 Filled Syndet Bar | 3.2 | 2.8 | 2.8 |

None of the products exhibited any grittiness. The tabulated panel results show that the filled syndet product of the present invention of Example 18 provides significant improvements over the unfilled syndet product of Example 17.

EXAMPLES 19 TO 23

Various soap bars were made with the E-516 fatty acid blend to demonstrate the advantages of using such soap bars filled with about 10% $CaCO_3$, and wherein the $CaCO_3$ where used, was either uncoated, or was reacted and coated with coco fatty acid as in Example 21 hereof, in accordance with the teachings of the present invention. These soap bar compositions were as follows:

TABLE 10

| Composition Example | Weight % Uncoated Filler | Coated Filler | Coating On $CaCO_3$ Fatty Acid | Weight % |
|---|---|---|---|---|
| 19 | 0 | 0 | None | — |
| 20 | 10 | 0 | None | — |
| 21 | 9.7 | 0 | None | — |
| 22 | 10 | 0 | None | — |
| 23 | 0 | 10 | Coco | 3 |

The soap bars of Examples 19 to 22 were control or comparison samples. The $CaCO_3$ used in these examples was ground $CaCO_3$. In Example 20, the $CaCO_3$ was added to the soap making recipe prior to the neutralization of the fatty acid therein. In Example 21, 0.3% coco fatty acid was added to the soap making recipe after the neutralization of the fatty acid therein. In Example 22, 3% mineral oil was added to the soap recipe. The soap bar of Example 23, it is to be noted, only contained 0.3% of the coco fatty acid in the form of the coating on the $CaCO_3$.

The resulting soap bar products were then evaluated for flash foam, lather volume and richness/creaminess characteristics by a test panel. The following Table 11 lists the results of such evaluations:

TABLE 11

| Product Of Example | Average Panel Ratings For: Flash Foam | Lather Volume | Richness/ Creaminess |
|---|---|---|---|
| 19 | 2.8 | 2.4 | 3.2 |
| 20 | 3.4 | 3.0 | 2.6 |
| 21 | 3.4 | 2.6 | 3.6 |
| 22 | 2.6 | 2.4 | 2.4 |
| 23 | 3.2 | 2.8 | 3.4 |

The products of Examples 19, 22 and 23 exhibited no grittiness during use, although the bar of Example 22 was very lubricious due to the presence of the mineral oil. The bar of Example 20 exhibited some grittiness. The bar of Example 21 exhibited grittiness both visually and tactually before use, but not during use due to the thickness and lubricity of the lather made therewith. There was a wide spread in the richness/creaminess ratings obtained for the bar of Example 20. The tst results indicate that the filled soap bar of the present invention, of Example 23, provided significant improvements in the evaluated properties as compared to the unfilled and filled control samples, taking into consideration the grittiness and other test characteristics, and the level of fatty acid coating used (0.3%) based on the soap bar formulation.

EXAMPLES 24 TO 26

Soap bars were made with the E-516 acid blend to demonstrate the advantages of using such soap bar filled with about 10% dolomite, $[CaMg(CO_3)_2]$, and wherein the dolomite, where used, was reacted and coated with coco fatty acid as disclosed in Example I.4 hereof and in accordance with the teachings of the present invention. These soap bar compositions were as follows:

TABLE 12

| Composition Example | Weight % Uncoated Filler | Coated Filler | Coating On Dolomite Fatty Acid | Weight % |
|---|---|---|---|---|
| 24 | 0 | 0 | None | — |
| 25 | 10 | 0 | None | — |
| 26 | 0 | 10 | Coco | 3 |

The soap bars of Examples 24 and 25 were control samples. The dolomite used was coarse material. The resulting soap bar products were then evaluated for flash foam, lather volume and richness/creaminess characteristics by a test panel. The following Table 13 lists the results of such evaluations:

TABLE 13

| Product Of Example | Average Panel Ratings For Flash Foam | Lather Volume | Richness/ Creaminess |
|---|---|---|---|
| 24 | 2.8 | 2.4 | 3.2 |
| 25 | 2.8 | 1.8 | 1.8 |
| 26 | 3.2 | 3.4 | 3.6 |

The product of Example 24 was not gritty. The products of Example 25 and 26 exhibited the same level of grittiness. However, the product of Example 26, which is a product of the present invention, showed very significant improvements in the panel ratings therefor, and at a fatty acid coating weight percent level of only 0.3%, based on the weight of the entire composition, as compared to the ratings for the two control samples. The product of Example 26 also exhibited an improvement in the test panel results relative to the unfilled product of Example 24, even though the filled product of Example 25 showed a deterioration in such test results.

EXAMPLES 27 TO 29

Soap bars were made with the E-516 fatty acid blend to demonstrate the advantages of using such soap bars filled with about 10% aluminum trihydrate, $Al(OH)_3$ and wherein the aluminum trihydrate (ATH) where used, was reacted and coated with oleic acid as disclosed in Example I.3 hereof, and in accordance with the teachings of the present invention. These soap bar compositions were as follows:

TABLE 14

| Composition Example | Weight % Uncoated Filler | Coated Filler | Coating On ATH Fatty Acid | Weight % |
|---|---|---|---|---|
| 27 | 0 | 0 | None | 0 |

TABLE 14-continued

| Composition Example | Weight % Uncoated Filler | Weight % Coated Filler | Coating On ATH Fatty Acid | Coating On ATH Weight % |
|---|---|---|---|---|
| 28 | 10 | 0 | None | 0 |
| 29 | 0 | 10 | Oleic | 3 |

The soap bars of Examples 27 and 28 were control samples. The resulting soap bar products were then evaluated for flash foam, lather volume and richness/-creaminess characteristics by a test panel. The following Table 15 lists the results of such evaluations:

TABLE 15

| Product Of Example | Average Panel Ratings For: Flash Foam | Lather Volume | Richness/ Creaminess |
|---|---|---|---|
| 27 | 2.8 | 2.4 | 3.2 |
| 28 | 3.2 | 3.0 | 3.2 |
| 29 | 3.4 | 3.4 | 4.0 |

None of the samples exhibited any grittiness. The product of Example 29, which is a product representative of those of the present invention, showed signficant improvements in all the test ratings therefor, as compared to an unfilled product as well as with respect to a product filled with uncoated filler.

EXAMPLES 30 TO 33

Soap bars made from 70:30 and 50:50 blends of E-531 tallow acid and E-626 coconut fatty acid, and thus having relatively high coconut fatty acid contents, were made to demonstrate the utility of the coated fillers of the present invention with such products. The coated filler used in these examples was calcium carbonate coated and reacted with 3% coconut fatty acid as prepared in Example I.1 above. These soap bar formulations were as follows:

TABLE 16

| Composition Example | Fatty Acid Blend In Soap | Uncoated Filler | Coated Filler | Fatty Acids | Weight % |
|---|---|---|---|---|---|
| 30 | 70/30 tallow/coco | 0 | 0 | None | — |
| 31 | 70/30 tallow/coco | 0 | 10 | Coco | 3 |
| 32 | 50/50 tallow/coco | 0 | 0 | None | — |
| 33 | 50/50 tallow/coco | 0 | 10 | Coco | 3 |

Examples 30 and 32 were control samples. The resulting soap bar products were then evaluated for flash foam, lather volume and richness/creaminess characteristics by a test panel. The following Table 17 lists the results of such evaluations:

TABLE 17

| Product Of Example | Average Panel Ratings For Flash Foam | Lather Volume | Richness/ Creaminess |
|---|---|---|---|
| 30 | 3.2 | 3.4 | 3.8 |
| 31 | 2.8 | 3.2 | 3.6 |
| 32 | 3.6 | 4.0 | 3.8 |
| 33 | 3.6 | 3.2 | 3.6 |

The Example 33 product exhibited a trace of grittiness. The other products exhibited no grittiness. It is known that soap bar products made with blends of tallow acid and coconut fatty acid which contain relatively high levels of coconut fatty acid, i.e., 30%, tend to provide relatively high test panel ratings of the types discussed herein. The test results shown above indicate that the coated fillers of the present invention can be used to extend, with fillers that are relatively inexpensive, relative to the cost of fatty acid blends having high coconut fatty acid contents therein, without causing a substantial deterioration in the normally high levels of test characteristics normally associated with unfilled soap bar products made with such fatty acid blends.

EXAMPLES 34 TO 37

Soap bars made from E-516 fatty acid, and with and without pumice, an inert, unreactive filler, were prepared for the purposes of demonstrating the need to use reactive fillers, according to the teachings of the present invention, in order to obtain the benefits of the applicants invention. The pumice was used both uncoated and coated with stearic acid or coconut fatty acid as disclosed in Examples I.10 and I.6 hereof. The formulations used were as follows:

TABLE 18

| Composition Example | Weight % Uncoated Filler | Weight % Coated Filler | Coating On Pumice Fatty Acid | Coating On Pumice Weight % |
|---|---|---|---|---|
| 34 | 0 | 0 | None | — |
| 35 | 10 | 0 | None | — |
| 36 | 0 | 10 | Coco | 3 |
| 37 | 0 | 10 | Stearic | 10 |

The soap bar of Example 34 was a plodded bar, the other products were framed bars. The resulting soap bar products were then evaluated for flash foam, lather volume and richness/creaminess characteristics by a test panel. The following Table 19 lists the results of such evaluations:

TABLE 19

| Product Of Example | Average Panel Ratings For: Flash Foam | Lather Volume | Richness/ Creaminess |
|---|---|---|---|
| 34 | 2.8 | 2.4 | 3.2 |
| 35 | 3.0 | 2.4 | 2.8 |
| 36 | 2.8 | 2.2 | 2.4 |
| 37 | 1.6 | 2.4 | 2.4 |

The product of Example 34 was not gritty. The products of Examples 35, 36 and 37 were, respectively, extremely, very and moderately abrasive. These test results indicate that the use of inert fillers, coated or uncoated with fatty acid do not provide the advantages obtained with the coated reactive fillers of the present invention. The test panel ratings for the filled compositions of Examples 35–37 showed essentially no improvement over the bar product of Example 34 made with the E-516 fatty acid blend.

What is claimed is:

1. A synthetic detergent, a combination of soap and detergent or a soap, each in bar, form comprising particulate filler material capable of reacting chemically with fatty acid wherein the individual particles of said filler are coated with fatty acid that has been reacted with and is chemically bonded to said filler.

2. A synthetic detergent, combo or soap bar as in claim 1 comprising a particulate filler that has formed a salt with said fatty acid.

3. A synthetic detergent, combo or soap bar as in claim 2 wherein the salt forming cation is a metal cation wherein the metal is selected from the group consisting of Ca, Mg, Al, and Zn.

4. A synthetic detergent, combo or soap bar as in claim 3 wherein the particulate filler is selected from the group consisting of $CaCO_3$, $[CaMg(CO_3)_2]$, $Ca(BO_2)_2$, $Ca(OH)_2$, $MgCO_3$, CaO, MgO, $Al(OH)_3$, ZnO and $ZnCO_3$.

5. A bar as in claim 4 in which said fatty acid is a $C_4$ to $C_{26}$ saturated or unsaturated fatty acid.

6. A bar as in claim 5 in which said fatty acid is saturated.

7. A bar as in claim 5 in which said fatty acid is unsaturated.

8. A bar as in claim 5 in which said filler is $CaCO_3$.

9. A soap bar as in claim 5.

10. A syndet bar as in claim 5.

11. A combo bar as in claim 5.

12. A process of forming a filled synthetic, a detergent combination of detergent and soap or a soap such each in bar form comprising particulate filler material capable of reacting chemically with fatty acid wherein the individual particles of said filler are coated with fatty acid that has been reacted with and is chemically bonded to said filler which comprises the steps of:

(a) drying said particulate filler material, (b) treating said dried filler material with a first fatty acid at a temperature of about 95°+5° C. for about 0.5 to 2.0 hours so as to coat said particulate filler with a reaction product of said first fatty acid and said filler, (c) slurrying said coated particulate filler in either (i) a second fatty acid and then saponifying said second fatty acid or (ii) a synthetic detergent based syndet or a combination of detergent and soap or a soap composition, and (d) forming bars of synthetic detergent, combination of soap and detergent or soap from the resulting compositions, with the proviso that said steps (c) and (d) are conducted under such conditions as will safeguard the integrity of at least a substantial portion of the coating applied to said particulate filler in said step (b).

13. A process as in claim 12 in which, in said step (b), said particulate filler is chemically adapted to react with the carboxyl groups of said first fatty acid.

14. A process as in claim 13 in which said particulate material forms a salt with said first fatty acid with a metal cation wherein the metal is selected from the group consisting of Ca, Mg, Al, and Zn.

15. A process as in claim 12 in which said first fatty acid is a saturated or unsaturated $C_4$ to $C_{26}$ fatty acid.

16. A process as in claim 12 in which said first and second fatty acids are different fatty acids.

17. A process as in claim 12 in which a soap bar is prepared.

18. A process as in claim 12 in which a syndet bar is prepared.

19. A process as in claim 12 in which a combo bar is prepared.

20. A bar as in claim 4 comprising about 1 to 25 weight percent of said particulate filler.

21. A soap bar as in claim 20 comprising about 65 to about 90 weight percent of soap.

22. A syndet bar as in claim 20 comprising about 15 to 70 weight percent of surfactant.

23. A combo bar as in claim 20 comprising about 5 to 70 weight percent soap and about 10 to 80 weight % of synthetic detergent.

* * * * *